United States Patent [19]

Hutchinson

[11] Patent Number: 4,915,600

[45] Date of Patent: Apr. 10, 1990

[54] ROTARY APPARATUS WITH ROTATING MOBILE AND STATIONARY BLOCKING MEMBERS

[75] Inventor: William W. Hutchinson, Everett Wash.

[73] Assignee: Hutchinson Research and Development Corp., Lynnwood, Wash.

[21] Appl. No.: 256,887

[22] Filed: Oct. 12, 1988

[51] Int. Cl.[4] ..... F04B 49/02; F01C 1/30; F01C 21/12

[52] U.S. Cl. ..... 417/440; 418/221; 418/227

[58] Field of Search ..... 418/141, 221, 225, 227; 417/440

[56] References Cited

U.S. PATENT DOCUMENTS

| | | | |
|---|---|---|---|
| Re. 19,772 | 12/1935 | Dudley | 418/227 |
| 288,030 | 11/1883 | Dean | 417/442 |
| 377,143 | 1/1888 | Bullock . | |
| 1,265,070 | 5/1918 | Feyzes | 417/440 |
| 1,460,875 | 7/1923 | White | 417/440 |
| 1,523,785 | 1/1925 | Martin | 418/134 |
| 1,782,766 | 11/1930 | Randolph . | |
| 1,869,053 | 7/1932 | Dudley . | |
| 2,048,825 | 7/1936 | Smelser | 418/225 |
| 2,455,303 | 11/1948 | Grate | 418/134 |
| 2,776,086 | 1/1957 | Selden | 418/227 |
| 3,096,745 | 7/1963 | Thompson . | |
| 3,109,382 | 11/1963 | Farrell et al. | 418/141 |
| 3,472,146 | 10/1969 | Mazurkiewicz | 417/442 |
| 3,695,789 | 10/1972 | Jansson | 418/133 |
| 3,781,146 | 12/1973 | Bates | 418/227 |
| 3,846,055 | 11/1974 | Brundage | 418/227 |
| 3,924,980 | 12/1975 | Gordon | 418/227 |
| 3,941,527 | 3/1976 | Allington | 418/196 |
| 4,057,035 | 11/1977 | Su | 418/227 |

FOREIGN PATENT DOCUMENTS

| | | | |
|---|---|---|---|
| 3141753 | 5/1983 | Fed. Rep. of Germany | 418/227 |
| 1362686 | 8/1974 | United Kingdom | 418/227 |

OTHER PUBLICATIONS

"Hydraulic Motor Achieves High Overall Efficiency," J. Ronald Ullmann, Design News, 1/74.

*Primary Examiner*—John J. Vrablik
*Attorney, Agent, or Firm*—Seed and Berry

[57] ABSTRACT

A motor/pump includes a cylindrically shaped rotor journaled within a similarly shaped housing to define an annular fluid passageway therebetween. The annular passageway is divided into a plurality of discrete fluid chambers by mobile blocking members which are mounted on the rotor near its periphery and stationary blocking members which extend outwardly from the housing to block fluid passage. Both types of blocking members are preferably free to rotate in place. Fluid inlets and outlets positioned around the annular chamber alternately pressurize and depressurize the chambers formed by the blocking members. The stationary blocking members are coupled to the rotor for synchronous rotation to allow passage of the mobile blocking members thereby. One preferred embodiment includes dampeners in the fluid inlets and outlets so that rotation of motor/pump can be controlled to provide the desired motor/pump characteristics.

9 Claims, 5 Drawing Sheets

FIG. 1
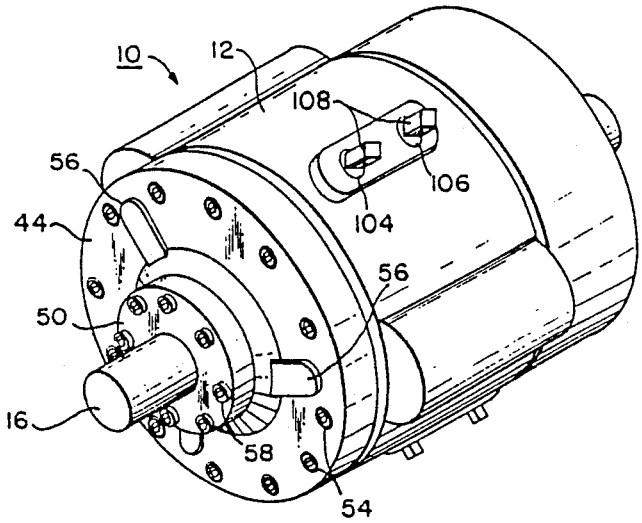
FIG. 3
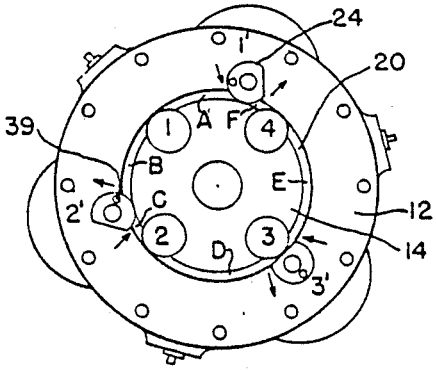
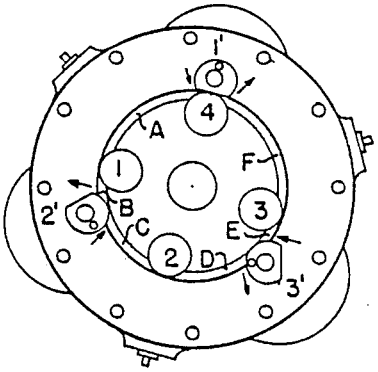
FIG. 2
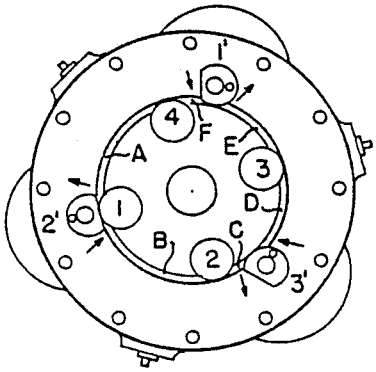
FIG. 4

ROTARY APPARATUS WITH ROTATING MOBILE AND STATIONARY BLOCKING MEMBERS

DESCRIPTION

1. Technical Field

This invention relates to rotary motors, and more particularly, to rotary motors having a plurality of fluid chambers positioned in an annular passageway for alternate pressurization and depressurization.

2. Background Art

Rotary motors of the basic type disclosed herein have been known in the art for some time. U.S. Pat. No. 1,869,053, to Dudley, for example, discloses a rotary motor having a cylindrical rotor journaled within the rubberlined cavity of a housing. As the rotor is smaller than the lined cavity, an annular passageway is formed therebetween. Three evenly spaced rubber abutments project inwardly from the housing to contact the rotor. Extending outwardly from the rotor to contact the rubber lining of the housing are four cylindrical abutments. These abutments combine to divide the annular passageway between the rotor and the housing into a number of discrete chambers which change in size and location as the rotor rotates. The cylindrical abutments which extend from the rotor include a recess which allows them to pass over the abutment which projects inwardly from the housing. The cylindrical abutments are coupled to gears which travel around an internal ring gear to ensure proper timing of the rotation of the cylindrical abutments so that their recesses will pass over the inwardly projecting abutments properly. The rotor is caused to rotate by pressurized fluid which enters the annular passageway on one side of each inwardly projecting abutment to pressurize the chamber defined by that abutment and a cylindrical abutment. The pressurized fluid will act on the cylindrical abutment at one end of the chamber and cause the rotor to rotate. As the cylindrical abutment is pushed by the pressurized fluid, it will eventually rotate past an outlet port adjacent the next inwardly projecting abutment, thereby depressurizing the chamber.

The arrangement disclosed in the Dudley patent has several disadvantages. First, a relatively heavy set of cylindrical abutments and accompanying gearing are rotated along with the rotor. This additional rotating weight will put extra stress on the bearings which must hold the rotor in place. An additional disadvantage of the arrangement disclosed in the Dudley patent is that the abutments which project inwardly from the housing are stationary and thus produce a wiping action between the rotor and the abutment. This wiping action is undesirable because it may cause undue wear on the rotor or alternately impede the free rotation of the rotor within the housing.

DISCLOSURE OF INVENTION

It is an object of this invention to provide an efficient rotary motor and pump.

It is another object of this invention to provide such a motor and pump which will mimimize friction and reduce wear on its moving parts.

It is another object of this invention to provide such a motor and pump which will allow the rotor elements thereof to be of lightweight construction.

It is another object of this invention to provide such a motor having a plurality of fluid chambers disposed between a housing cavity and a rotor journaled therein, and velocity seals between the rotor and housing cavity to substantially eliminate fluid communication between the fluid chambers while minimizing friction and wear.

It is another object of this invention to provide such a motor having a plurality of fluid inlets and fluid outlets which may be actuated alternately by a timing system coupled to the rotation of the rotor.

It is another object of this invention to provide a rotary motor and pump which can provide adjustable torque and flow.

It is another object of this invention to provide a rotary motor and pump which can be easily and accurately timed.

It is another object of this invention to provide a rotary motor and pump which will prevent back pressure from acting on the rotor.

These and other objects, which will become more apparent as the invention is more fully described below, are obtained by providing a motor having a cylindrical rotor journaled within a similarly shaped housing cavity. An annular passageway formed between the rotor and cavity walls is divided into discrete fluid chambers by mobile blocking members which extend outwardly from the rotor and stationary blocking members which project inwardly from the housing. During operation of the motor, the mobile blocking members will rotate with the rotor thereby moving around the annular passageway and causing the size and location of the fluid chambers to vary. Fluid inlets and outlets are placed at predetermined locations around the annular passageway to pressurize and depressurize the chambers as they move into communication with the inlet or outlet. The stationary blocking members are coupled to the rotor for rotation in place, thereby ensuring that recesses on the stationary blocking members will be positioned within the annular passageway at the proper time to allow the mobile blocking members to pass by.

In one preferred embodiment of the invention, the rotation in place of the stationary blocking members also functions to selectively permit communication between the fluid inlets and outlets and the fluid chambers. The mobile blocking members are preferably free to rotate in place within the rotor as the rotor rotates within the housing. This rotation aids in the formation of a velocity seal between the housing and the mobile blocking members to eliminate the need for contact with the housing cavity wall. A thin oil film is preferably provided between the mobile blocking member and the cavity wall to facilitate movement of the rotor within the housing.

In one preferred embodiment, a plurality of fluid inlet and outlet combinations include dampener mechanisms which may be selectively adjusted to provide variable torque and flow.

An alternative embodiment preferably includes an adjustment mechanism for enabling the gears timing the rotation of the stationary blocking members to be properly aligned with respect to the motor.

BRIEF DESCRIPTION OF THE DRAWINGS

FIG. 1 is an isometric view of a preferred embodiment of the invention.

FIG. 2 is a front elevation view of a preferred embodiment illustrated in a first operating position with the front sealing assembly removed.

FIG. 3 is a front elevation view illustrated in a second operating position with the front sealing assembly removed.

FIG. 4 is a front elevation view illustrated in a third position with the front sealing assembly removed.

BEST MODE FOR CARRYING OUT THE INVENTION

Figure 6:
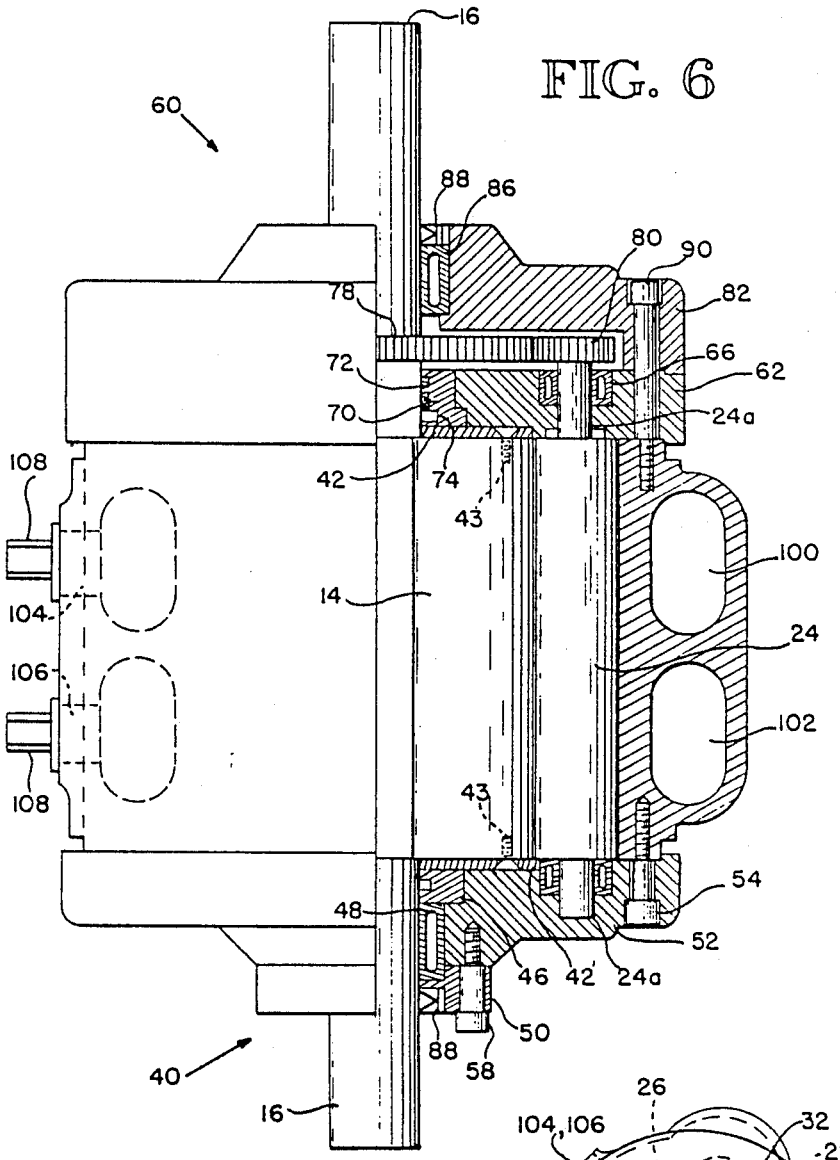
FIG. 6 is a top plan view of a preferred embodiment of the invention wherein the right side is illustrated with the top half of the housing removed.

A rotary motor pump 10 comprising a preferred embodiment of the invention is illustrated in FIGS. 1–7. Pressurized fluids are directed into a motor housing 12 to rotate a rotor 14 journaled therein. The rotor is coupled to an output shaft 16, which, in turn, may be coupled to a generator or other machine (not shown), as desired. The rotor 14 fits within a cavity 18 in the housing to form an annular passageway 20 therebetween. The passageway is, in turn, divided into a number of chambers which are alternately pressurized and depressurized to rotate the rotor within the housing.

Pressurized fluid is injected into the annular passageway at predetermined positions around the circumference of the passageway to pressurize fluid chambers in the annular passageway. The fluid chambers are formed by mobile blocking members 22, which project outwardly from the rotor, and stationary blocking members 24, which project inwardly from the housing as seen in FIG. 2. Fluid inlets 26 and fluid outlets 28 are preferably positioned adjacent each stationary blocking member as indicated by the arrows in FIG. 2. As it enters a fluid chamber, the pressurized fluid will exert force on the mobile blocking member and cause rotation of the rotor. This rotation will eventually move the mobile blocking member past a fluid outlet 28 adjacent the next stationary blocking member to depressurize the chamber. This cycle of alternating pressurization and depressurization produces continuous rotation of the rotor and output shaft for driving a generator or other machine.

Figure 5:
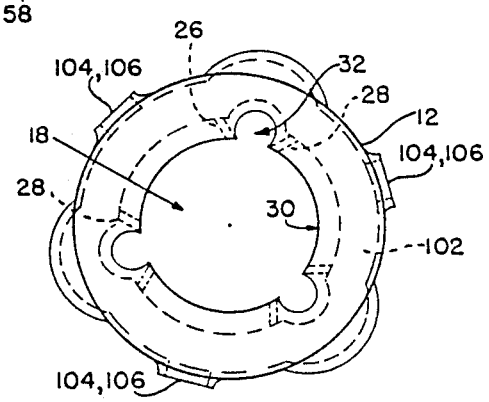
FIG. 5 is a front elevation view of the motor housing.
Figure 7:
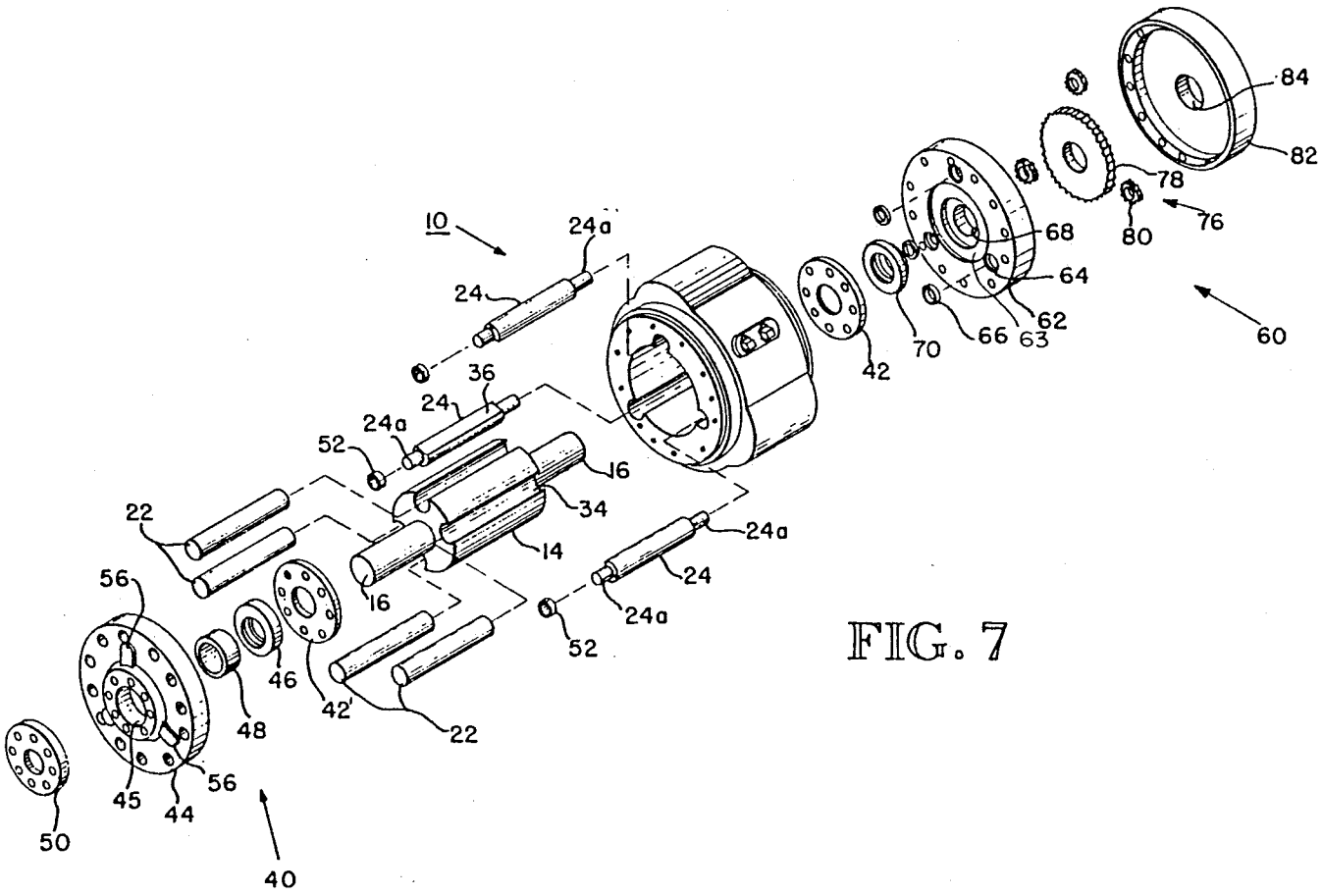
FIG. 7 is an exploded view of a preferred embodiment of the invention.

The housing 12 includes a substantially cylindrical cavity 18 having interior cavity walls 30 (see FIG. 5). The cavity includes cylindrically shaped recesses 32 evenly spaced about its periphery for housing the stationary blocking members 24. Adjacent each recess and on opposite sides thereof are fluid inlets 26 and fluid outlets 28. An input passageway 100 and an output passageway 102 extend around the housing as shown in FIGS. 6 and 7 to provide fluid communication with the cavity. In the embodiment disclosed in FIGS. 1–7, three inlet ports 104 and three outlet ports 106 provide possible means for fluid communication between the passageways and remote fluid input and output sources. In operation only one input port and one output port need be activated. The remaining four ports may be sealed off using plugs 108.

Journaled within the cavity 18 is a rotor 14. The rotor includes cylindrically shaped recesses 34 which extend inwardly from the periphery of the rotor to house the mobile blocking members 22. The mobile blocking members are preferably able to roll within the recesses during rotation of the rotor. This rolling action enables the mobile blocking members to move along the cavity walls without slipping or wiping against them.

Figure 8:
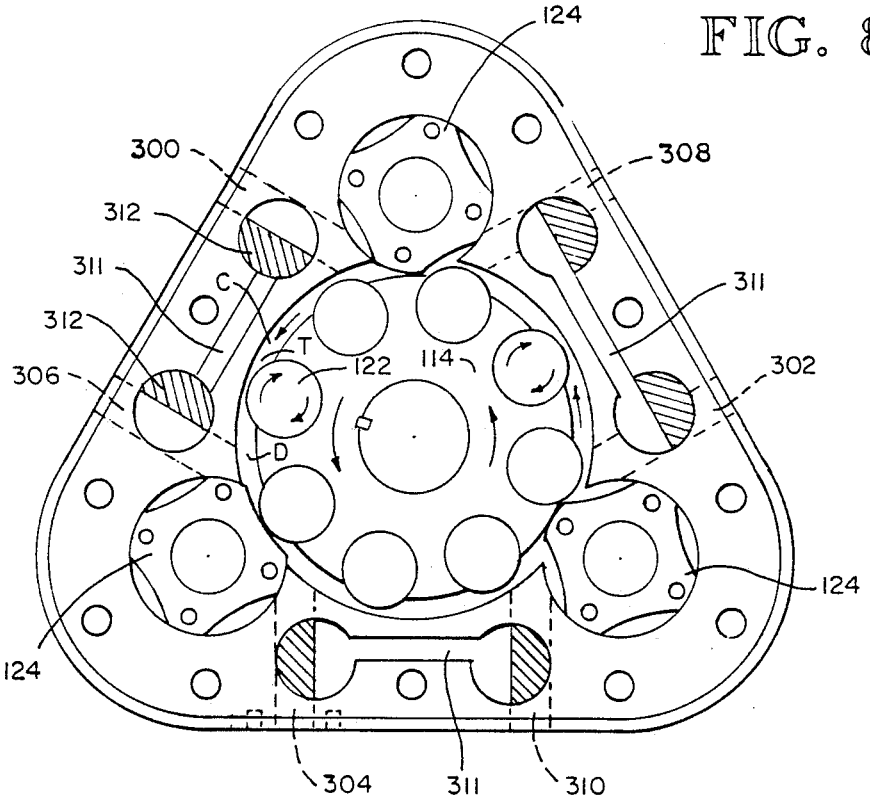
FIG. 8 is a cross-section of an alternate embodiment of the invention including dampener mechanisms to provide variable torque and flow.

The mobile blocking members are sized and positioned so that they do not contact the housing. The crescent shape of the cavities within the rotor circumscribe more than a hemicylindrical surface and thus prevents centrifugal force from urging the mobile blocking members against the housing while allowing the members to be loosely retained and free floating therein. As illustrated in FIG. 8, the rotation of the mobile blocking members 122, combined with the rotation of the rotor 114 forms an area of turbulence T in front of each mobile blocking member. This turbulence prevents fluid communication between the adjacent fluid chambers C, D defined by the mobile blocking member 122, thereby providing a velocity seal and eliminating the need for contact between the rotor 114 and the housing. This lack of actual contact, as contrasted with the wiping or slipping action in prior rotary motor/pumps, enables a great reduction in friction and accompanying heat build up within the present motor. A thin oil layer is preferably provided between the mobile blocking member and the recess to facilitate rolling.

In the preferred embodiments disclosed herein, the output shaft 16 is coaxially mounted within the rotor, as seen in FIG. 7. The rotor, mobile blocking members, and stationary blocking members all fit within the housing cavity to define an annular passageway 20 which is segregated into a plurality of fluid chambers. As seen in FIGS. 2–4, the fluid chambers are defined by the mobile blocking members and stationary blocking members which extend outwardly from the rotor and housing, respectively, to block fluid communication around the annular passageway. The rotor shaft and mobile blocking members are preferably of lightweight construction to optimize the weight advantage already obtained by not rotating a heavy timing structure with the rotor. The stationary blocking members include a truncated surface 36 to allow the mobile blocking members to pass by them during rotation of the rotor. The truncated surfaces may be either planar, as disclosed herein, or of a concave shape correspondingly to the exterior of the mobile blocking members to allow the mobile blocking members to pass by. The stationary blocking members preferably include an aperture 39 positioned opposite the truncated surfaces to balance the stationary blocking member for improved rotation in place.

The rear end of the cavity 18 is closed by a rear sealing assembly 60, best illustrated in FIGS. 6 and 7. A rear keeper plate 42 abuts the rear end of the rotor 14 and is connected thereto by machine screws 43. The rear keeper plate is positioned within a recess 63 in a center plate 62 and spaced apart from the center plate at a close tolerance. In the preferred embodiment illustrated herein, for example, a 0.002-inch spacing is used. The rotation of the keeper plate within the recess causes turbulence, which forms a velocity seal to prevent the escape of fluid from the annular chambers. A front keeper plate 42' is similarly journaled in the front end plate 45 to form a velocity seal there as well, as described below. The center plate includes apertures 64 therein to permit passage of a central shaft 24a integral with the stationary blocking members 24 therethrough, as shown in FIG. 6. Fitted within the aperture 64 is a bearing 66 for rollably supporting the shaft 24a. The output shaft 16 passes through a central aperture 68 in the center plate 62, as seen in FIG. 6. A bushing 70 and accompanying O-rings 72 journal the output shaft 16 and hold thrust bearing 74 in place. Positioned rearwardly of the center plate is a gear assembly 76. A driving or spur gear 78 is fixed on the output shaft 16 by a driving or spur gear pin (not shown). The pitch diameter of the driving gear is equal to the diameter of the rotor, and the pitch diameter of the timing gears is equal to the diameter of the stationary blocking members such that the stationary members and rotor will travel at the same peripheral speed, thereby eliminating any slipping or wiping between the stationary blocking members and rotor. Mounted on the central shaft 24a of the stationary blocking members 24 are timing gears 80 which are held in place by timing gear pins (not shown) and mesh with the spur gear 78, as seen in FIG. 6. A rear end plate 82 abuts the periphery of the center plate 62 and is recessed to extend rearward of the gear assembly 76, as seen in FIGS. 6 and 7. A central aperture 84 within the rear plate 82 houses a bearing 86 and oil seal 88 which journal the output shaft 16, as illustrated in FIG. 6. Cap screws 90 extend through the end plate and center plate and into the housing to secure the rear sealing assembly 60 to the housing.

Figure 11:
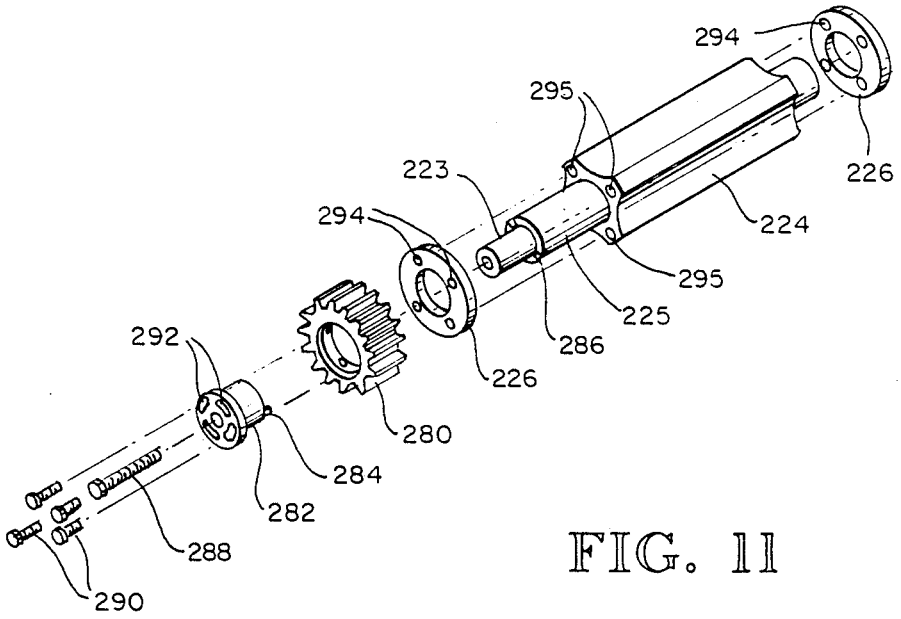
FIG. 11 is an exploded isometric view of an improved timing gear adjustment mechanism used on an alternate embodiment of the invention.

Alternate preferred embodiments of the invention utilize an improved timing gear adjustment mechanism 200 as illustrated in FIG. 11. A stationary blocking member 224 includes reduced shaft portions 223, 225 which project outwardly from the stationary blocking member beyond the rotor. Sealing plates 226, preferably of brass construction, are mounted on the reduced shaft portions and combine with the keeper plate to form a velocity seal at the front and back ends of the annular chamber. The sealing plates are preferably sized so that the outer portion thereof is spaced apart from the outer portion of the keeper plates at close tolerance (0.002 inch in preferred embodiment illustrated herein) to form a velocity seal. Turbulence between the two moving parts will effectively block the passage of fluid. A timing gear 280 and timing gear hub 282 are mounted on the reduced portion rearward of the seal. The hub includes projecting splines 284 which are received in slots 286 in the reduced shaft portion and the hub is secured to the reduced shaft portion by bolt 288. The timing gear is journaled about the hub and secured thereto by gear bolts 290 which extend through arc shaped slots 292 in the hub and are received in bores 294, 295 within the sealing plates and stationary blocking members as shown in FIG. 11. The combined timing gear adjustment mechanism allows the position of the timing gear to be readily "fine tuned" by loosening the gear bolts and rotating the timing gear with respect to the hub and stationary blocking member.

The front end of the housing is closed by a front sealing assembly 40, illustrated in FIGS. 6 and 7. A front keeper plate 42' fits on the output shaft 16 and abuts the front end of the rotor 14. The keeper plate is secured to the rotor by machine screws 43. The front and sides of the keeper plate fit within a front end plate 44, as seen in FIG. 6. The front end plate includes a central aperture 45 which houses a bushing 46 and bearing 48 for journaling the output shaft 16. A recess within the front end plate holds bearings 52 for rollably supporting the front end of the central shaft 24a of the stationary blocking members 24. Cap screws 54 secure the front end plate 44 to the housing. Mounted on the output shaft 16 forward of the front end plate is a thrust adjusting plate 50. This thrust adjusting plate is secured to the front end plate by a plurality of cap screws 58, as seen in FIGS. 1 and 6, and holds the front end plate at a desired point relative to the cavity once it is adjusted. An oil seal 88 is also provided betweenthe thrust adjusting plate and the output shaft, as seen in FIG. 6.

The operation of the rotary motor 10 of this invention can best be seen by referring to FIGS. 2–4 These figures illustrate the mechanics of the fluid inflow and outflow during a cycle of the engine. In each of the drawings, the stationary blocking members are designated by prime numbers 1', 2', and 3'. The mobile blocking members are designated by whole numbers 1, 2, 3, and 4. The fluid chambers formed in the annular passageway 20 by these blocking members are designated by reference letters A, B, C, D, E, and F. The fluid inlets 26 and fluid outlet 28 are designated by arrows on either side of the stationary blocking members which indicate the direction (in or out) of fluid flow.

In the position illustrated in FIG. 2, pressurized fluid is entering chambers A, C, and E. The pressurized fluid in these chambers exerts pressure on the blocking members which define these chambers. As only the mobile blocking members are free to move, this pressure will act against mobile blocking members 1, 2, and 4, causing the rotor to rotate in the counterclockwise direction shown.

In the position illustrated in FIG. 3, chambers A and C continue to receive pressurized fluid input, which exerts force on mobile blocking members 1 and 2. The chamber between mobile blocking members 3 and 4, designated chamber F in FIG. 3, has moved out of communication with the fluid input adjacent stationary blocking member 3' and is now in communication with the fluid outlet adjacent stationary blocking member 1'. A new chamber E has been formed between stationary blocking member 3' and mobile blocking member 3, and is being pressurized by the fluid inlet adjacent the stationary blocking member 3'. Chambers F, B, and D are exhausting fluid.

In the position illustrated in FIG. 4, mobile blocking member 1 has moved to a position adjacent stationary blocking member 2' to place chamber A in communication with the fluid outlet adjacent stationary member 2'.

Although the embodiment disclosed herein utilizes three stationary blocking members and four mobile blocking members, it will be obvious to those of ordinary skill in the art that different combinations of stationary blocking members and mobile blocking members could be utilized without departing from the spirit of the invention. It is not intended, therefore, that the invention be limited to the specific embodiment disclosed herein, but rather to include all embodiments which utilize the inventive principles disclosed herein.

Figure 9:
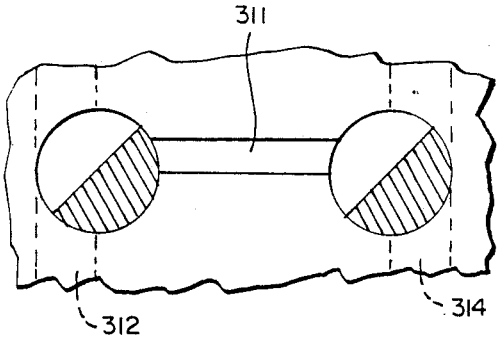
FIG. 9 is a cutaway view of a dampener mechanism of FIG. 8 illustrating the inlet and outlet dampeners in a partially open position.
Figure 10:
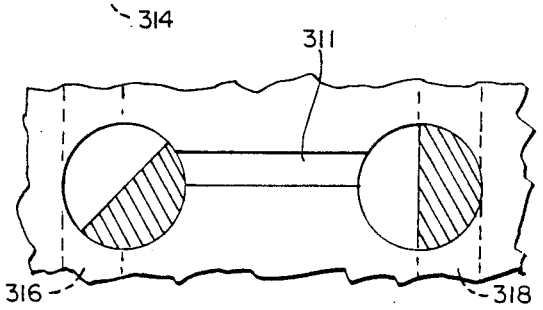
FIG. 10 is a cutaway view of a dampener mechanism of FIG. 8 illustrating the inlet dampener in a partially open position and the outlet dampener in a fully open position.

An alternate preferred embodiment of the invention is illustrated in FIGS. 8–10. In this preferred embodiment, an inlet passage 300, 302, 304 and an outlet passage 306, 308, 310 are positioned between each adjacent pair of stationary blocking members 124. A connecting channel 311 extends between each pair of inlet and outlet passages for fluid communication therebetween when desired. Dampeners 312 positioned within each passage allow the flow of fluid through the passage to be selectively regulated to allow the motor/pump to operate in a plurality of different modes. A conventional linkage mechanism (not shown) or the like is used to position the dampeners in the desired position. The dampeners in inlet 300 and outlet 306, for example, are in a fully open position to enable maximum fluid to pass through. Note the dampeners have closed off the connecting channel. The dampeners in inlet 304 and outlet 310, on the other hand, are in a fully closed or lock-up position to block all fluid passage. Again the connecting channel is closed off by the dampeners. The dampeners in inlet 302 and outlet 308 are positioned in a bypass position which closes off external communication yet allows fluid to pass through the connecting channel. FIGS. 9 and 10 illustrate other possible dampener operating positions. In FIG. 9 the dampeners in both the inlet passage 312 and the outlet passage are in a partially open position. FIG. 10 illustrates a dampener in an inlet passage 316 in a partially open position while the corresponding dampener in an outlet passage 318 is fully open. The adjustable dampeners illustrated herein provide greatly enhanced flexibility in the motor/pump of this invention and greatly enhance its versatility. With one set of inlet/outlet passages fully open and the others in the bi-pass position, a low-torque, high-rpm motor/-pump is possible. With all inlet-outlet passages open, a high torque set-up is possible. Partially open dampeners provide adjustability and flexibility. The inlet/outlet passages can be placed in lock-up position to stop or slow the motor/pump. When using steam or other expandable fluids, it may be desirable to use the partially open inlet passage and fully open outlet passage for maximum efficiency.

It is not intended, then, that the invention be limited to the specific embodiments disclosed herein, but rather that it include all equivalent embodiments which are within the spirit of the invention.

I claim:

1. A rotating machine comprising:

a housing having an elongated cylindrically shaped cavity defined by an interior cavity wall;

a cylindrical rotor journaled to the housing for rotation within the cavity and having an exterior dimension less than the cavity dimensions to define an annular passageway therebetween; and a plurality of free floating cylindrical, mobile blocking members, spaced at a plurality of locations on the rotor and in the annular passageway to define discrete fluid chambers therein, and received for rotation within the cylindrical rotor and having peripheral positions extending sufficiently near the cavity wall and spaced away therefrom so that rotation of the rotor causes the mobile blocking members to rotate within the rotor and cause substantial fluid turbulence between the mobile blocking members and the cavity wall to form a velocity seal to block the passage of fluid between adjacent fluid chambers within the annular passageway;

a stationary blocking member rotatably coupled to and timed with the rotor to permit passage of the mobile blocking members thereby; and a fluid inlet and a fluid outlet in communication with the annular passageway and the discrete fluid chamber.

2. The rotating machine of claim 1 including at least three mobile blocking members on the rotor so that at least three discrete fluid chambers are formed therebetween and means for variably allowing and preventing fluid communication between the first and third chambers to bypass the second chamber for controlling the torque and speed of the rotating machine.

3. A rotary apparatus comprising:

a housing having an elongated cylindrically shaped cavity therein defined by an interior cavity wall;

a cylindrical rotor journaled within the cavity, the rotor having exterior dimensions less than the interior dimensions of the cavity so as to define an annular passageway between the rotor and the interior cavity wall;

a plurality of free floating cylindrically shaped mobile blocking members rollably mounted in the rotor and having portions extending outwardly from the perimeter of the rotor to a location sufficiently near the cavity wall and sufficiently spaced away therefrom to define discrete fluid chambers in the annular passageway and to cause substantial fluid turbulence forward of the mobile blocking members at the cavity wall when the rotor rotates so as to form a velocity seal to block the passage of fluid between adjacent fluid chambers within the annular passageway;

a plurality of stationary blocking members rotatably mounted within the housing such that an outermost portion of each stationary blocking member extends inwardly into the annular passageway to a location near the rotor to block the passage of fluid within the annular passageway, the stationary blocking members including a truncated portion to allow passage of the mobile blocking members during rotation of the rotor, the stationary blocking member being rotatably coupled to the rotor to ensure passage of the truncated portion through the annular passageway at a time corresponding to the passage of the mobile blocking members by the stationary blocking members;

a plurality of fluid inlets with the annular passageway, each fluid inlet positioned on one side of a stationary blocking member so as to communicate with the fluid chamber formed between that stationary blocking member and a mobile blocking member, the fluid inlet allowing entry of fluids into the fluid chamber;

a plurality of fluid outlets communicating with the annular passageway, each fluid outlet positioned on the opposite side of a stationary blocking member from the fluid inlets so as to communicate with the fluid chamber and allow fluids within the fluid chamber to be exhausted; and sealing means mounted on opposite ends of the housing for sealing the ends of the annular passageway.

4. The apparatus of claim 1 wherein each stationary blocking member is rotatably coupled to the rotor by a driving gear secured to a shaft which extends rearwardly from the center of the rotor and a plurality of timing gears extending from shafts which extend rearwardly from the center of the stationary blocking members, the timing gears meshing with the driving gear to rotate the stationary blocking members during the rotation of the rotor.

5. The apparatus of claim 4 wherein the pitch diameter of the driving gear is equal to the diameter of the rotor, and the pitch diameter of the timing gears is equal to the diameter of the stationary blocking members such that the stationary members and rotor will travel at the same peripheral speed, thereby eliminating any slipping or wiping between the stationary blocking members and rotor.

6. The apparatus of claim 3 wherein the mobile blocking members are mounted on the rotor within cylindrically shaped recesses such that the mobile blocking members will roll in place as the rotor and mobile blocking members rotate within the housing.

7. The apparatus of claim 3 wherein the fluid inlets and fluid outlets include adjustable dampeners therein regulating the flow into and out of the annular passageway.

8. The apparatus of claim 7, further including a connecting channel extending between each fluid inlet and corresponding fluid outlet, the dampeners additionally positioned to control fluid communication through the connecting channel.

9. The apparatus of claim 3 wherein the sealing means includes end plate assemblies having keeper plates housed within end plates, wherein each keeper plate is coupled to the rotor for rotation therewith and spaced apart from the end plate at close tolerance.

* * * * *

UNITED STATES PATENT AND TRADEMARK OFFICE

CERTIFICATE OF CORRECTION

PATENT NO. : 4,915,600

DATED : April 10, 1990

INVENTOR(S) : William W. Hutchinson

It is certified that error appears in the above-identified patent and that said Letters Patent is hereby corrected as shown below:

In line 1 of claim 4; "claim 1" should read --claim 3--.

Signed and Sealed this

Twenty-eighth Day of May, 1991

*Attest:*

HARRY F. MANBECK, JR.

*Attesting Officer*

*Commissioner of Patents and Trademarks*